United States Patent [19]

Sirois

[11] Patent Number: 4,625,829

[45] Date of Patent: Dec. 2, 1986

[54] SPEAKER GRILL

[76] Inventor: Ronald A. Sirois, 1420 Raritan Rd., Scotch Plains, N.J. 07076

[21] Appl. No.: 593,667

[22] Filed: Mar. 26, 1984

[51] Int. Cl.[4] ..... G10K 11/00

[52] U.S. Cl. ..... 181/175; 181/141; 181/144; 181/150; 181/155

[58] Field of Search ..... 181/141, 149, 150, 153, 181/155, 175, 191, 144, 147, 199; 179/146 E; 381/88-90, 86

[56] References Cited

U.S. PATENT DOCUMENTS

| | | | |
|---|---|---|---|
| 1,786,279 | 12/1930 | Wolff | 181/155 |
| 1,936,396 | 11/1933 | Jefferis | 179/146 E |
| 2,186,276 | 1/1940 | Schwarz et al. | 181/150 |
| 2,511,917 | 6/1950 | Hornor | 181/199 X |
| 2,643,727 | 6/1953 | Leon | 181/155 |
| 4,122,315 | 10/1978 | Schroeder et al. | 181/147 X |
| 4,303,142 | 12/1981 | Urban | 181/144 |
| 4,365,113 | 12/1982 | Soma et al. | 181/144 X |

*Primary Examiner*—Benjamin R. Fuller

*Attorney, Agent, or Firm*—Janine J. Weins; Michael J. Weins

[57] ABSTRACT

The present invention relates to a grill comprising one or more acoustic shells to be used in combination with conventional acoustic speakers. The speaker grill of the present invention in it simplest form is an acoustic shell which serves to focus the acoustic emissions generated by the speaker. In a preferred embodiment of the present invention the speaker grill is constructed of a series of acoustic shells. The different acoustic shells may focus different portions of the acoustic spectrum. The speaker grill of the present invention has particular use with an automobile speaker. The speaker grill of the present invention can be used in any listening area and has particular application to small environments, environments having spacial restriction, critical listening environments such as recording studios, and environments which utilize sound reinforcement systems.

26 Claims, 10 Drawing Figures

SPEAKER GRILL

DESCRIPTION

1. Field of Invention

The present invention relates to a grill comprising one or more acoustic sheels to be used in combination with an acoustic speaker. The speaker grill of the present invention has particular use with an automobile speaker.

2. Background Art

When acoustic speakers are used in confined environments, such as the interior of an automobile, it is difficult to achieve good stereophonic sound reproduction. Attempts to improve the sound reproduction within an automobile have in part been overcome by the use of multiple speakers directed towards the listening area. The use of multiple speakers has several disadvantages, among these are that the interior space is further limited and the speaker arrangement is frequently not aesthetically attractive. Additionally, if the multiple speakers encroach into the passenger area they may be inadvertently damaged.

Within a confined environment such as an automobile, secondary reflections from elements within the interior having different acoustic reflectivity can cause undesirable acoustic effects. Undesirable acoustic reflectively can be accentuated in small compact cars, as well as when acoustic speakers are used in a restricted environment such as small and/or irregularly shaped rooms.

For the above reasons speaker grills used to prevent physical damage to acoustic speaker cones, to diffuse the acoustic emissions and/or to direct the acoustic emissions generated by the speaker are frequently used within automobiles and other listening environments in which spacial limitations exist.

U.S. Pat. No. 4,365,113 of Hiroshi Soma, Makoto Iyobe, Takekazu Iijima and Yutaka Moriyama entitled: "Speaker Unit For Automobile Vehicles" teaches a speaker unit for use in automobiles in which the woofer is flush mounted on the rear deck while the medium and high range speaker unit is mounted in a housing attached to the frame of the woofer in such a manner that the acoustic emissions are directed towards the passenger compartment. The medium and high range speaker unit is provided with a grill to assure that the acoustic emissions are directed in a forward direction. This speaker unit has the disadvantage in that, although the acoustic emissions from the medium and high range speaker unit are directed forward, the acoustic emissions are not focused and therefore the acoustic emissions can be reflected from the side windows, dome light, interior roof, and walls of the automobile in an undesirable manner. Undesirable acoustic reflections can diminish the quality of the perceived stereophonic sound.

SUMMARY OF INVENTION

An object of the present invention is to provide a speaker grill which will focus the acoustic emissions generated by a speaker.

Another object of the present invention is to provide a speaker grill which will enhance stereophonic separation.

Another object of the present invention is to provide a speaker grill which will reduce the exposure of speaker cones to the deleterious effects of moisture and ultraviolet radiation.

Yet another object of the present invention is to improve the quality of perceived stereophonic sound within a spacially or configurationally restricted environment.

Yet another object of the present invention is to improve the quality of perceived stereophonic sound within an automobile.

These and other objects of the present invention will become apparent from the following figures, description and examples.

The present invention is directed to a speaker grill which can be used with conventional acoustic speakers. The speaker grill of the present invention in it simplest form is an acoustic shell which serves to focus the acoustic emissions generated by the speaker.

In a preferred embodiment of the present invention the speaker grill is constructed of a series of acoustic shells. The different acoustic shells may focus different portions of the acoustic spectrum.

The acoustic shell directing the lower frequency acoustic emissions may be provided with a port which permits a portion of the low frequency acoustic emissions to be direct counter to the higher frequency emissions. The low frequency portion of the acoustic emissions which are counter directed pass through the port and are redirected by a secondary reflecting surface, such as the rear window of an automobile, for recombination with the higher frequency acoustic emissions. This redirection by a secondary reflecting surface effects a time separation of a portion of the low frequency acoustic emissions and results in stereo enhancement of the acoustic signal.

In a preferred embodiment the speaker grill of the present invention is so designed that in addition to focusing the acoustic emissions the speaker grill shields the speaker cone from ultraviolet radiation, and thereby extends the life of the speaker.

In another preferred embodiment the acoustic shells of the speaker grill can be collapsed when the speaker is not in operation and thereby the speaker cone can be protected from inadvertent damage and the deleterious effects of the atmosphere including moisture and ultraviolet radiation.

The speaker grills of the present invention can be used with a single speaker, a pair of speakers, or with speaker units comprised of two or more speakers covering different frequency ranges.

BEST MODE FOR CARRYING THE INVENTION INTO PRACTICE

Figure 1:
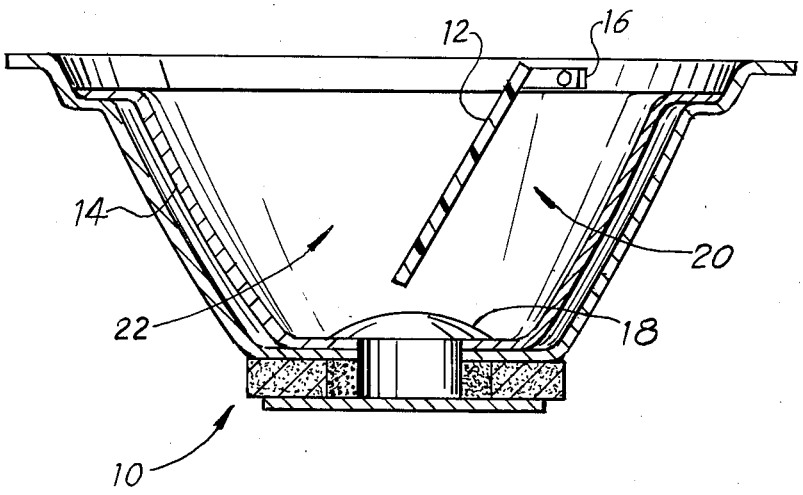
Fig. 1 PRIOR ART
FIG. 1 is a schematic representation of a prior art speaker for use in an automobile employing a deflection baffle for directing the acoustic emissions.

FIG. 1 is a schematic representation of a prior art speaker for use in an automobile. The speaker 10 is provided with a deflection baffle 12 for directing the acoustic emissions. The baffle 12 is suspended within the speaker cone 14 by suspension hangers 16. The baffle 12 is inclined with respect to the horizontal to such an extent that the baffle 12 is nearly parallel to one side of the speaker cone 14. The baffle 12 terminates at a point slightly above the junction of the speaker cone 14 and the voice coil 18. The baffle 12 divides the speaker cone 14 into two regions. The first region 20 being closest to the listening area while the second region 22 is furthest from the listening area. Acoustic emissions within the first region 20 are reflected by the baffle 12 towards the listening region while acoustic emissions within the second region 22 are directed away from the listening region. The acoustic emissions which are initially directed away from the listening area are redirected towards of the listening area by a secondary reflecting surface such as the rear window of an automobile. Thus the listener perceives a sound a portion of which is directed in the direction of the listener, and a portion of which is directed away from the listening direction and then redirected by a secondary reflecting surface towards the listening area. This results in a perceived stereophonic separation.

The acoustic emissions from automobile speakers of the above description are not focused and therefore undesirable secondary reflections from the automobile interior may occur which will diminish the quality of the sound perceived by the listener. The present invention eliminates this problem by providing an acoustic speaker with a grill containing one or more acoustic shells, the shells in turn act as an acoustic lens and focus the acoustic emissions so that undesirable secondary reflections from components of the automobile interior are reduced.

Figure 2:
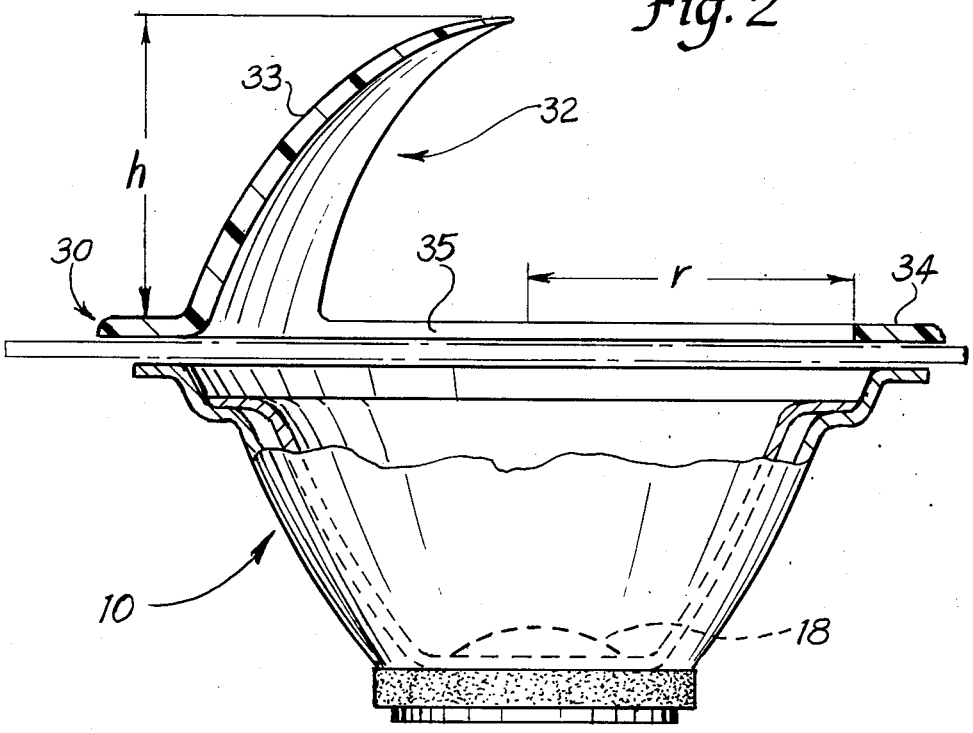
FIG. 2 is a schematic representation of a speaker grill in accordance with the present invention. The speaker grill has an acoustic shell for focusing acoustic emissions.

FIG. 2 is a schematic representation of a cross section of a speaker grill of the present invention. The speaker grill 30 has an acoustic shell 32 for focusing the acoustic emissions. The acoustic shell 32 has a contour similar to that of a band shell. The acoustic shell 32 is attached to a frame 34 which in turn is placed over the speaker cone 10.

The contour of the acoustic shell 32 will preferably be a smooth gradual curving surface which is concave when viewed from the speaker cone 10. The vertical cross section 33 should preferably approach an exponential curve with the curvature increasing as the distance from the speaker cone 10 increases. It is further preferred that the maximum height, h, of the shell 32 above the frame 34 be not more than about the maximum radius r of the speaker cone 10, and that the projection of the acoustic shell 32 onto the grill opening 35 be less than approximately one half the area of the opening 35. It is further preferred that horizontal cross sections of the acoustic shell 32 approximate an arc.

Figure 3:
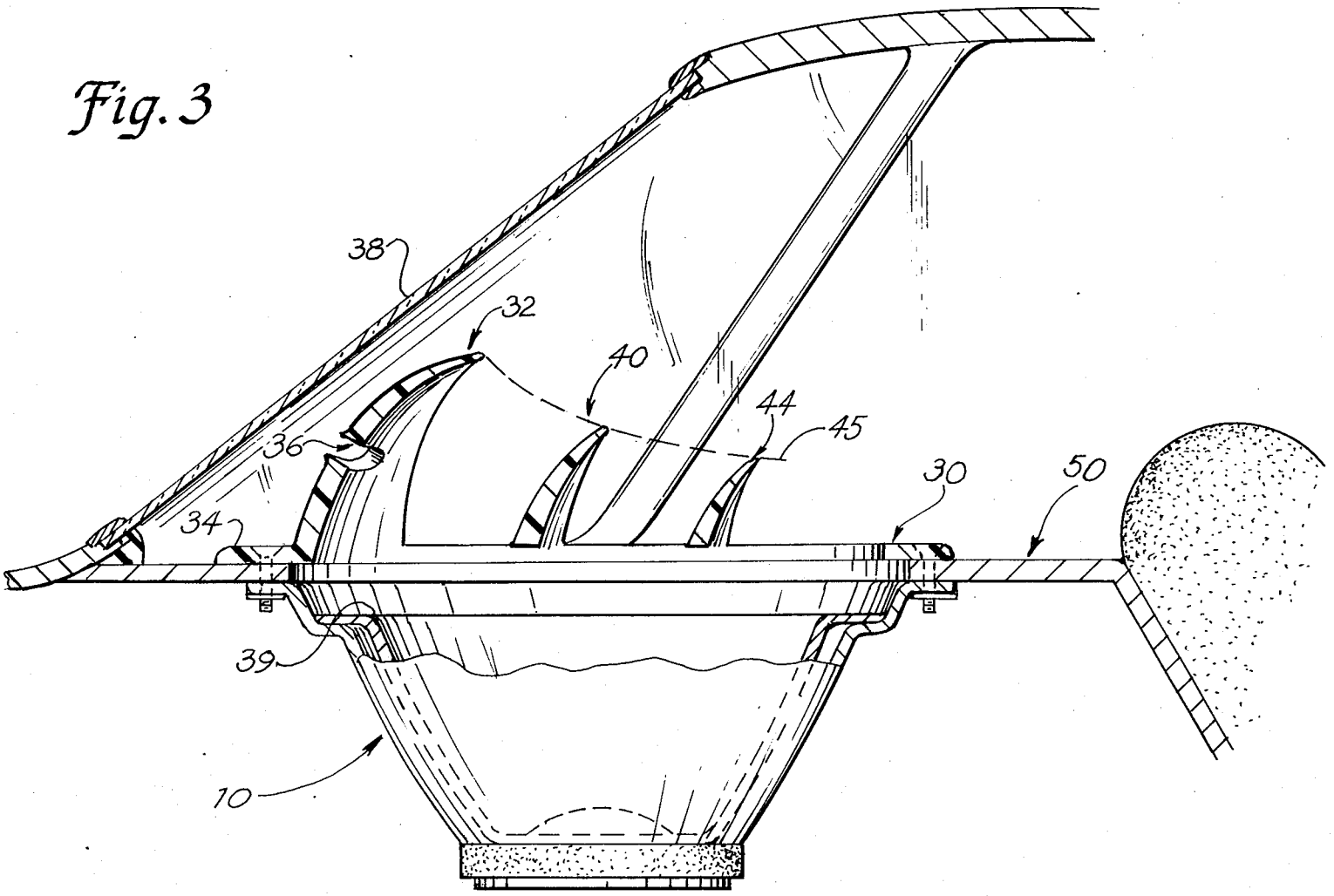
FIG. 3 is a schematic representation of another embodiment of the present invention in which multiple acoustic shells are used and the acoustic shell which directs the low frequency acoustic emissions is provided with a port. The port allows a portion of the low frequency acoustic emissions to escape the confines of the acoustic shell and be directed towards a secondary reflecting surface such as the rear window of an automobile, the secondary reflecting surface redirects the acoustic emissions towards the listening area.
Figure 4:
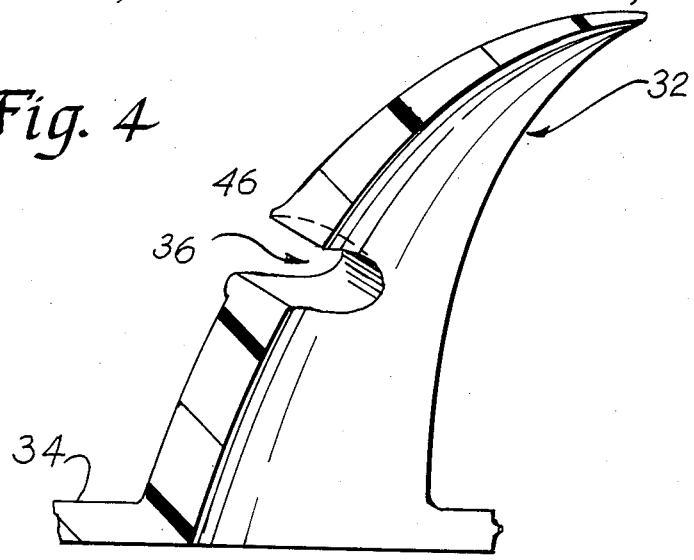
FIG. 4 is a cross section of the acoustic shell containing the port in FIG. 3.

FIG. 3 is a schematic representation of a second embodiment of the present invention. This embodiment differs from the embodiment of FIG. 2 in two respects. First in that the first acoustic shell 32 is provided with a port 36 which allows a portion of the acoustic emissions to escape the confines of the acoustic shell 32 and be directed towards a secondary reflecting surface such as the rear window 38 of an automobile. Preferably this port 36 is an opening with a horizontal axis greater than the vertical axis. The preferred configuration for the port 36 would be elliptical with a minor axis of approximately 1 cm and a major axis of approximately 5 to 8 cm. The port 36 is preferably positioned over the pressure center of the acoustic shell 32. This means that a vertical line passing through the center of the port 36 would intersect the speaker cone 10 at ts edge 39. The secondary reflection of a portion of the acoustic emissions by a secondary reflecting surface such as the rear window of an automobile 38, effects a time separation which contributes to stereophonic enhancement of the perceived sound.

The second manner in which the embodiment shown in FIG. 3 differs from the embodiment shown in FIG. 2 is that multiple acoustic shells are employed. In addition to the first acoustic shell 32 there is a second acoustic shell 40 and a third acoustic shell 44. The first acoustic shell 32, the second acoustic shell 40 and the third acoustic shell 44 are so spaced as to partition the speaker cone 10 into three regions of decreasing cross sectional areas. When the speaker grill 30 is mounted on the rear deck 50 of an automobile the first acoustic shell 32 is located nearest to the rear window 38 and furthest from the listening area. In moving away from the rear window 38 towards the listening area the acoustic shells progressively decrease in size with the smallest acoustic shell 44 closest to the listening area. Preferably the height of the acoustic shells decrease exponentially as is illustrated by the dashed line 45.

Figure 5:
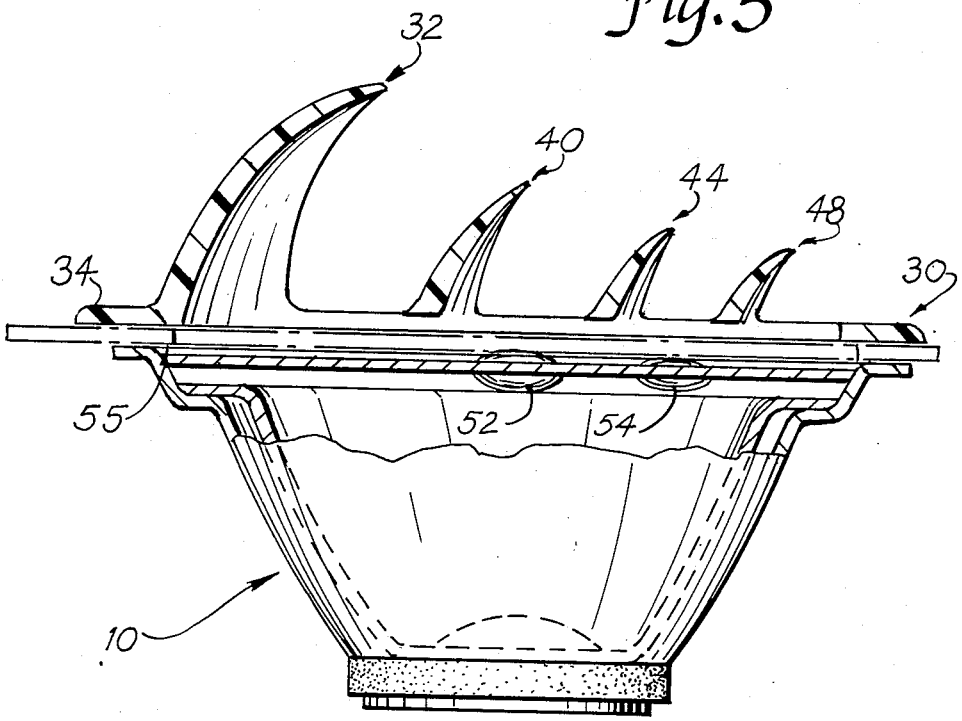
FIG. 5 is a schematic representation of a preferred embodiment of the speaker grill of the present invention. In this embodiment the speaker grill is placed over a low frequency speaker and suspended within the domain of the low frequency speaker and beneath the speaker grill are a midrange speaker and a high frequency speaker.

FIG. 5 is a schematic representation of a third embodiment of the present invention. In this embodiment four acoustic shells are used in combination with the speaker grill 30, a first acoustic shell 32, a second acoustic shell 40, a third acoustic shell 44 and a fourth acoustic shell 48. These acoustic shells, like those in FIG. 3, are arranged in order of decreasing height as one moves in the direction of the listening area. Each acoustic shell serves to focus the acoustic emissions in the direction of the listening area and each acoustic shell presents an angled wavefront of diminishing resistance to emanation.

In the embodiment shown in FIG. 5 a mid-range speaker 52 and a high-range speaker 54 are suspended within the low range speaker 10. The midrange speaker 52 is preferably positioned within the low range speaker 10 in the region defined by the second shell 40 and the third shell 44. The high range speaker 54 is preferably positioned within the low range speaker 10 in the region defined by the third shell 44 and fourth shell 48. As the number of acoustic shells is increased it is possible to reduce the maximum height of the largest acoustic shell. It is preferred to have the height of the largest acoustic shell less than about 0.5 r where r is the maximum radius of a circular speaker core, or in the case of non-circular speakers the minimum diameter of the speaker opening.

Furthermore it is preferred that the maximum number of acoustic shells be less than about 10 so as to avoid attenuation of the acoustic emissions.

Figure 6:
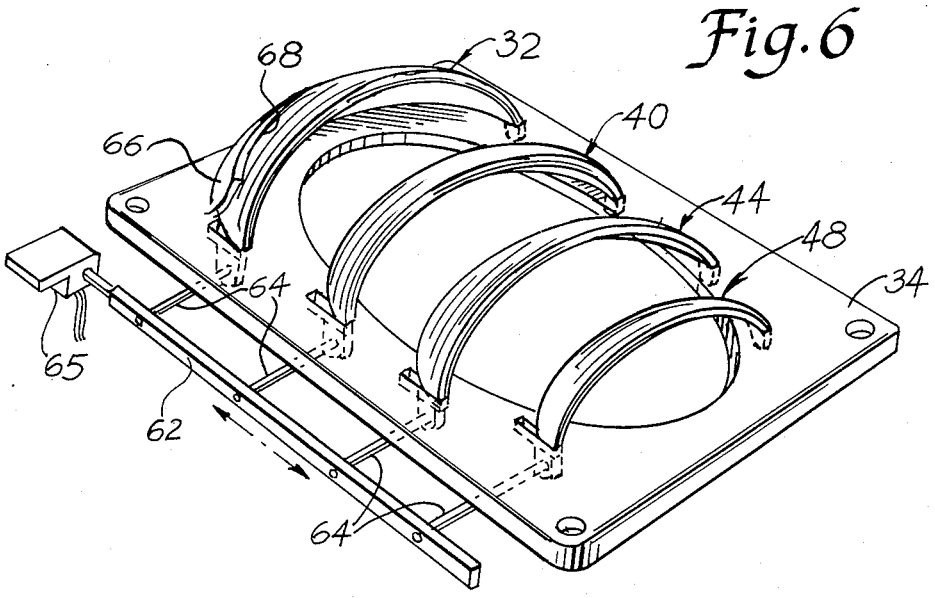
FIG. 6 is a schematic representation of an embodiment of the speaker grill of the present invention in which the acoustic shells can be collapsed so as to protect the speaker when the speaker is not in use.

FIG. 6 is a schematic representation of an embodiment of the present invention in which the acoustic shells are collapsible. The first acoustic shell 32, the second acoustic shell 40, the third acoustic shell 44 and the forth acoustic shell 48 are pivotably mounted in a frame 34. The acoustic shells are collapsed by a collapsing means. The collapsing means illustrated in FIG. 6 ties the acoustic shells 32, 40, 44 and 48 to an activator arm 62 by tie arms 64 which are pivotally mounted to the acoustic shells 32, 40, 44 and 48 and to the activator arm 62. The activator arm 62 is moved by an activating mechanism 65 such as a pneumatic cylinder, a servo motor, magnetic relay or other actuating mechanism. Other means such as gearing could be used to collapse the acoustic shells. The acoustic shells could be collapsed by manual means and opened by the appropriate utilization of catches and springs.

Figure 7:
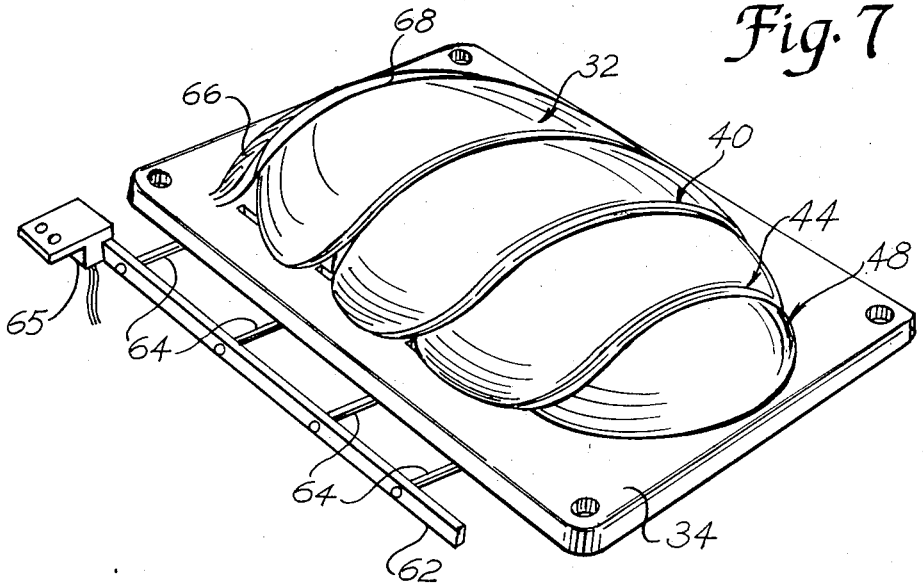
FIG. 7 is a schematic representation of the acoustic shells shown in FIG. 6 when the speaker is not in use.

FIG. 7 is a schematic representation of the acoustic shells shown in FIG. 6 when the acoustic shells are in the closed position. To provide for full coverage of the speaker when the acoustic shells are collapsed a flap 66 can be attached to the base 68 of the first shell 32. When the acoustic shells are in the closed position and the first acoustic shell 32 is provided with a flap 66 the speaker is protected from the deleterious effects of the atmosphere.

Figure 8:
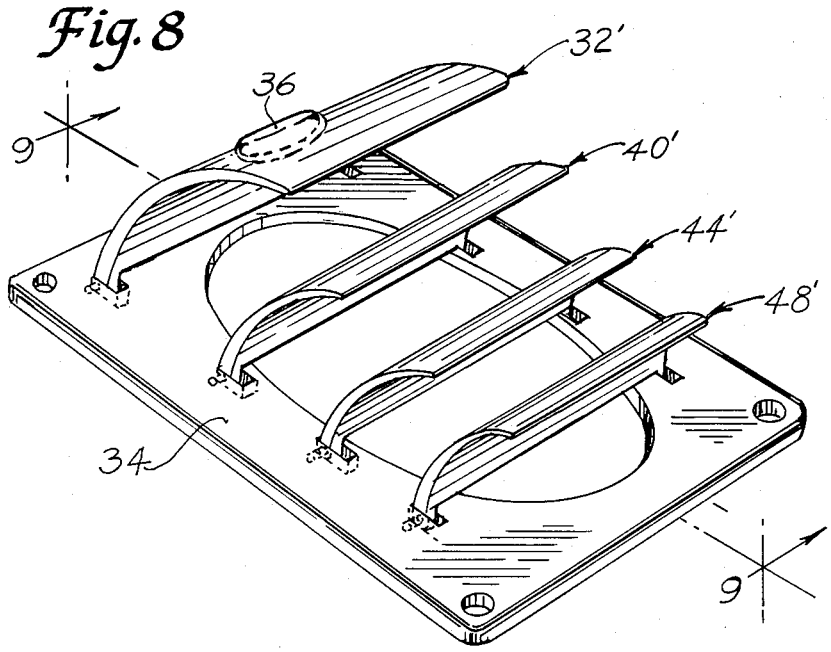
FIG. 8 is a schematic representation of another embodiment of the present invention. In this embodiment the acoustic shells serve to direct the acoustic emissions in the forward direction.

FIG. 8 is a schematic representation showing the construction of a series of collapsible acoustic shells in accordance with yet another embodiment of the present invention. The acoustic shells 32', 40', 44' and 48' shown in FIG. 8 differ from the acoustic shells of FIG. 6 in that the acoustic shells shown in FIG. 8 are curved only in the vertical plane and thereby focus the acoustic emissions in the forward directions, but do not focus the acoustic emissions with respect to the horizontal plane. The first acoustic shell 32' is provided with a port 36' which allows a portion of the low frequency acoustic emissions to escape the confines of acoustic shell 32 and be reflected in the direction of the listening area by a secondary reflecting surface.

Figure 9:
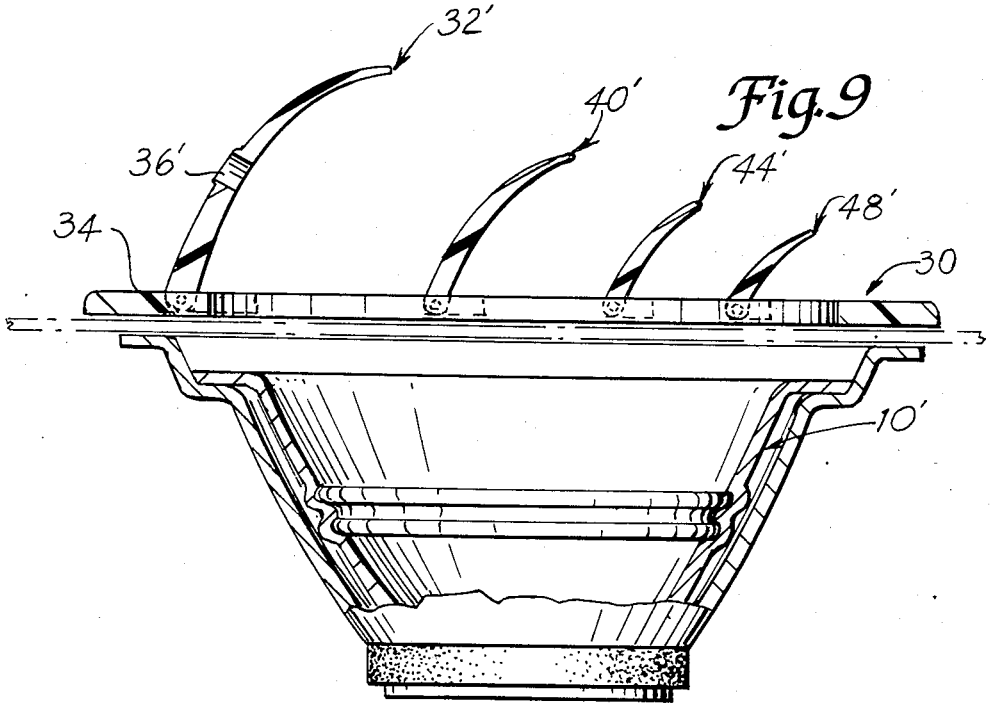
FIG. 9 is a cross sectional view of the speaker grill shown in FIG. 8.

FIG. 9 is a cross sectional view of FIG. 8 and shows the contour of the acoustic shells 32', 40', 44' and 48'. The speaker grill 30 is positioned over a ribbed low frequency speaker 10'.

EXAMPLE

Figure 10:
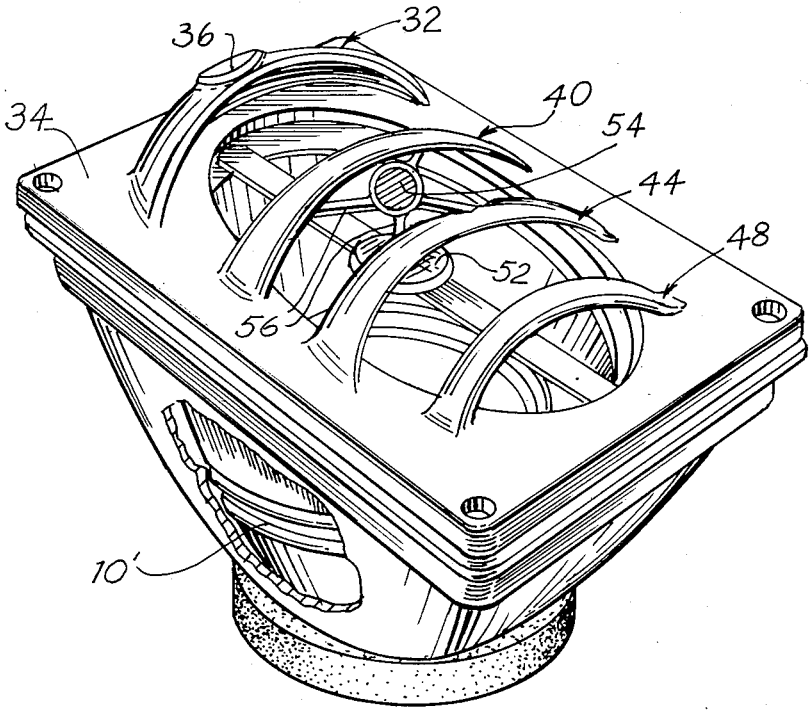
FIG. 10 is a schematic representation of a preferred embodiment of the speaker grill of the present invention in which three speakers covering different ranges of the acoustic spectrum are used in combination with a speaker grill having four acoustic shells.

A pair of speaker grills similar to the speaker grill shown in FIG. 10 are positioned within an automobile over a pair of rear deck speaker units. The speaker units are provided with three different speakers, a ribbed low frequency speaker 10', a midrange speaker 52 and a high range speaker 54. The midrange speaker 52 is suspended within the ribbed low frequency speaker 10' and is positioned between the projection of the second acoustic shell 40 and the third acoustic shell 44. Placed between the second acoustic shell 40 and the third acoustic shell 44 is a high range speaker 54. The high range speaker 54 is attached to the acoustic shells 40 and 44 by positioning struts 56. The first acoustic shell 32 is provided with a port 36 which allows a portion of the lower frequency acoustic emissions to escape the confines of the acoustic shell 32 and be redirected by a secondary reflecting surface into the listening area. The secondary reflection of a portion of the low frequency acoustic emissions gives the effect of a time separation with respect to a portion of the low frequency acoustic emissions. The speaker units are provided with electronics such that frequencies of 50 Hz to 1000 Hz are delivered to the ribbed low frequency speaker 10', frequencies of 1000 Hz to 10,000 Hz are delivered to the midrange range speaker 52, and frequencies of 10,000 Hz to 20,000 Hz are delivered to the high range speaker 54 with an approximate 10% overlap in frequency. The acoustic shells are so designed as to effectively focus the acoustic emissions towards the listening area.

Although the invention has been described in particular reference to use of the present invention within an automobile, the present invention can be used in any listening area and has particular application to small environments, environments having spacial restriction, critical listening environments such as recording studios, and environments which utilize sound reinforcement systems.

While the novel features of this invention have been described in terms of preferred embodiments and particular applications, it will be appreciated that various omissions and substitutions in form and in detail to the invention may be made by those skilled in the art without departing from the spirit of the invention.

What I claim is:

1. A grill to be used in combination with an acoustic speaker comprising:

a frame for placement over the acoustic speaker having a passage therethrough, said passage having an area; and a first acoustic shell attached to said frame and extending over a portion of said passage, said portion being so limited that said first shell's projection onto said passage is less than approximately one half the area of said passage.

2. The grill of claim 1 wherein said first acoustic shell is provided with a port.

3. The grill of claim 1 further comprising at least one additional acoustic shell.

4. The grill of claim 2 further comprising at least one additonal acoustic shell.

5. The grill of claim 1 wherein said first acoustic shell has a vertical cross section which approximates an exponential curve.

6. The grill of claim 5 wherein said first acoustic shell has a horizontal cross section which approximates an arc.

7. The grill of claim 3 wherein said acoustic shells have vertical cross sections which approximate exponential curves.

8. The grill of claim 4 wherein said acoustic shells have horizontal cross sections which approximate arcs.

9. An acoustic speaker system comprising:

at least one acoustic speaker for generating acoustic emissions;

a frame having a passage therethrough, said passage having an area and being positioned over said acoustic speaker; and a first acoustic shell attached to said frame, said first acoustic shell having a projection onto said passage which is less than approximately one half the area of said passage.

10. The acoustic speaker system of claim 9 wherein said first acoustic shell is provided with a port.

11. The acoustic speaker system of claim 9 further comprising at least one additional acoustic shell.

12. The acoustic speaker system of claim 10 further comprising at least one additional acoustic shell.

13. The acoustic speaker system of claim 9 wherein said first acoustic shell has a vertical cross section which approximates an exponential curve.

14. The acoustic speaker system of claim 9 wherein said first acoustic shell has a horizontal cross section which approximates an arc.

15. The acoustic speaker system of claim 11 wherein said acoustic shells have vertical cross section which approximate exponential curves.

16. The acoustic speaker system of claim 15 wherein said acoustic shells have horizontal cross sections which approximate arcs.

17. An acoustic speaker system comprising:

a first acoustic speaker;

a frame with a passage therethrough positioned over said first acoustic speaker;

a first acoustic shell attached to said frame;

a second acoustic shell attached to said frame and spaced apart from said first acoustic shell;

a third acoustic shell attached to said frame and spaced apart from said first and said second acoustic shells;

a fourth acoustic shell spaced apart from said first, said second and said third acoustic shells;

a second acoustic speaker positioned between said second and said third acoustic shells; and a third acoustic speaker positioned between said first acoustic speaker.

18. A grill to be used in combination with an acoustic speaker comprising:

a frame having a passage therethrough said passage having an area;

a first acoustic shell attached to said frame and extending over a portion of said passage, said portion being so limited that said first shell's projection onto said passage is less than approximately one half the area of said passage; and at least one additional acoustic shell, wherein said acoustic shells have vertical cross sections which approximate exponential curves and said acoustic shells progressively decrease in height.

19. A grill to be used in combination with an acoustic speaker comprising:

a frame having a passage therethrough said passage having an area;

a first acoustic shell attached to said frame and and extending over a portion of said passage, said portion being so limited that said first shell's projection onto said passage is less than approximately one half the area of said passage;

and at least one additional acoustic shell, wherein said acoustic shells have horizontal cross sections which approximate exponential curves and said acoustic shells progressively decrease in height.

20. The grill of claim 19 wherein said first shell is provided with a port.

21. The grill of claim 18 wherein said acoustic shells are pivotably attached to said frame and said grill further comprises;

means for collapsing said acoustic shells.

22. The grill of claim 19 wherein said acoustic shells are pivotably attached to said frame and said grill further comprises;

means for collapsing said acoustic shells.

23. The grill of claim 20 wherein said acoustic shells are pivotably attached to said frame and said grill further comprises;

means for collapsing said acoustic shells.

24. The grill of claim 18 wherein said decrease in height is exponential.

25. The grill of claim 19 wherein said decrease in height is exponential.

26. The grill of claim 20 wherein said decrease in height is exponential.

* * * * *